US005161802A

United States Patent [19]

Daechsel

[11] Patent Number: 5,161,802

[45] Date of Patent: Nov. 10, 1992

[54] GOLF PRACTICE DEVICE

[76] Inventor: Ernest A. Daechsel, 35 Cotton Avenue, Scarborough, Ontario, Canada, M1K 1Z5

[21] Appl. No.: 660,785

[22] Filed: Feb. 26, 1991

[51] Int. Cl.[5] ..... A63B 69/36

[52] U.S. Cl. ..... 273/186.3; 273/185 B; 273/187.1; 273/186.1

[58] Field of Search ..... 273/35 R, 183 R, 183 D, 273/186 R, 186 A, 186 AA, 186 B, 186 C, 194 R, 194 A; 434/252

[56] References Cited

U.S. PATENT DOCUMENTS

| | | | |
|---|---|---|---|
| 2,787,470 | 4/1957 | Barrus et al. | 273/186 AA |
| 3,820,795 | 6/1974 | Taylor | 273/186 A |
| 4,456,257 | 6/1984 | Perkins | 273/186 R |
| 4,693,479 | 9/1987 | McGwire | 273/186 A |
| 4,819,942 | 4/1989 | Lee et al. | 273/186 A |
| 4,858,934 | 8/1989 | Ladick et al. | 273/186 A |
| 4,911,450 | 3/1990 | Rabold | 273/186 A |
| 4,913,441 | 4/1990 | Freer | 273/186 A |
| 4,971,325 | 11/1990 | Lipps | 273/183 B |
| 4,971,328 | 11/1990 | Hernberg | 273/186 A |

FOREIGN PATENT DOCUMENTS

| | | | |
|---|---|---|---|
| 1270422 | 4/1972 | United Kingdom | 273/186 AA |

*Primary Examiner*—William H. Grieb
*Assistant Examiner*—Jessica J. Harrison
*Attorney, Agent, or Firm*—Fay, Sharpe, Beall, Fagan, Minnich & McKee

[57] ABSTRACT

A golf practice device comprising a golf club handle, and a shaft cut shorter than normal, with a unique head weighted to equal the swing of a regular club. The head contains a battery for a light, which is centrally mounted with lens and iris to produce a focused, rectangular spot of light, parallel to the shaft center line. The device also has a combination level-and-centrifugal switch that turns on the light spot when the shaft is level at the start of the down swing, and also as the head travels through the bottom of the swing. The rectangular light beam shows the path of the swing through a target ball, allowing the user to check the accuracy of the swing as well as the squareness of the club head to a target line. The target comprises a golf ball with two electronic receivers on either side in a straight line. The visual light path shows the direction of the swing, and the sound from the electronic receiver indicates to the golfer when a precise swing has been achieved. As repeat accuracy improves with practice, the light beam can be narrowed by adjusting the iris for still greater accuracy.

31 Claims, 5 Drawing Sheets

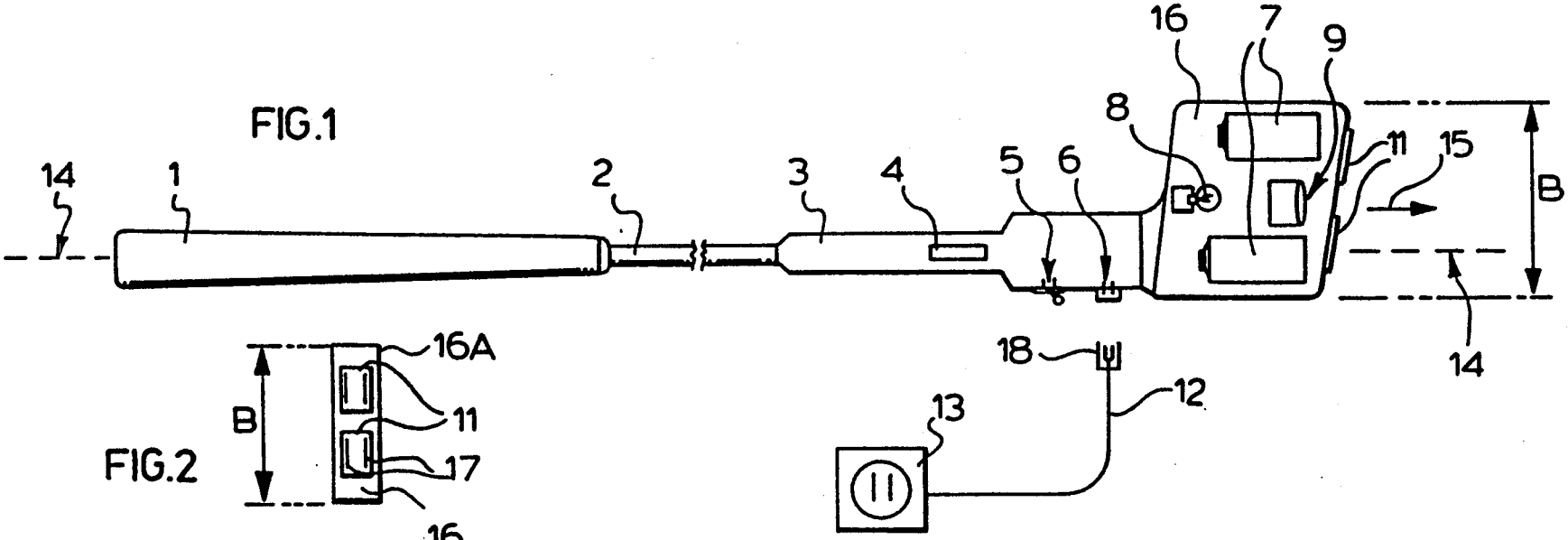
FIG.1
FIG.2
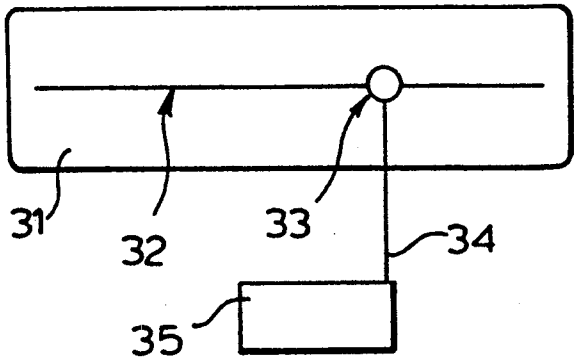
FIG.3
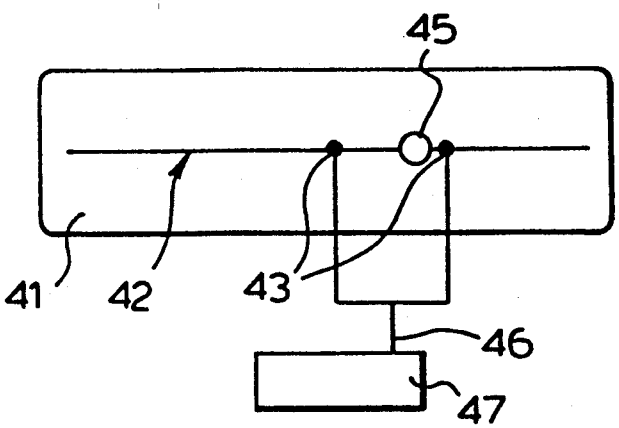
FIG.4

FIG. 7
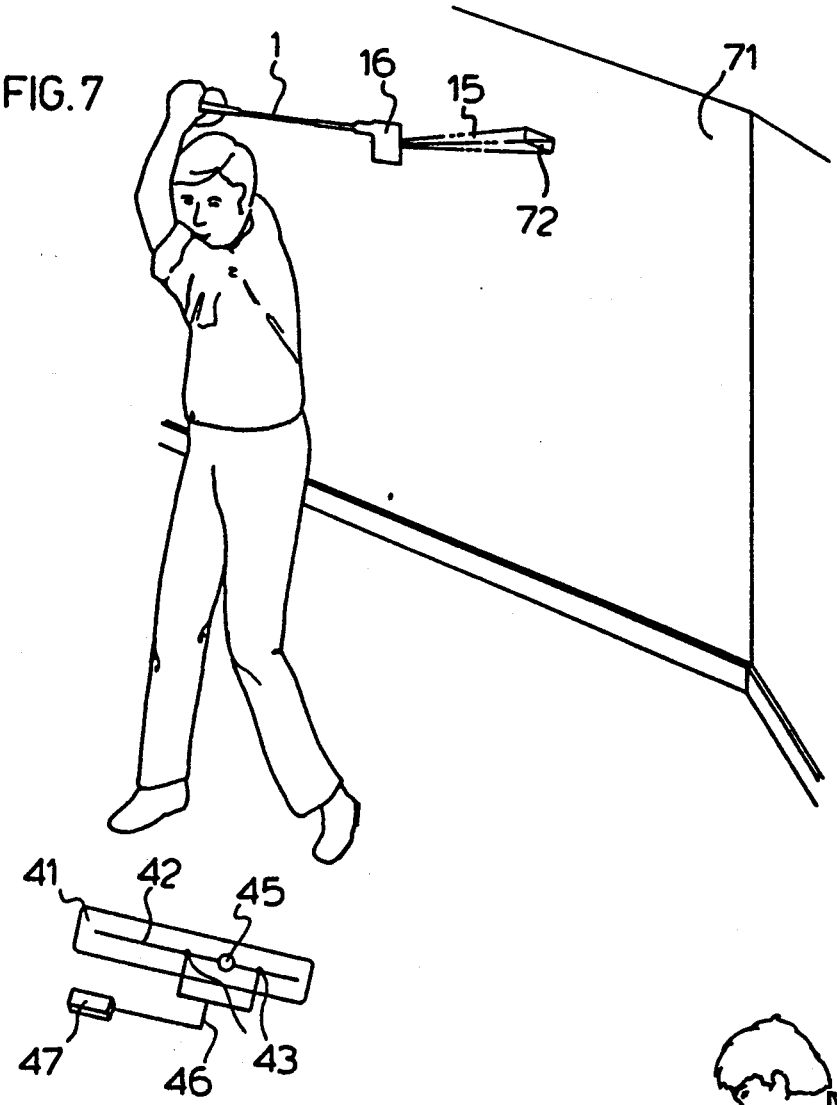
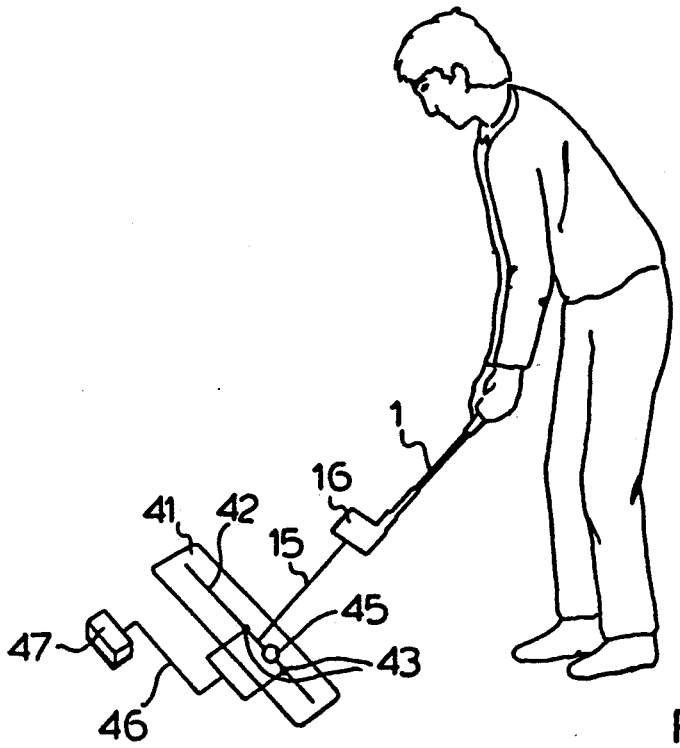
FIG. 8

GOLF PRACTICE DEVICE

FIELD OF THE INVENTION

The present invention relates in general to sports training equipment, and more particularly to a golf practice device designed to be used at home to improve a golfer's score by increasing the accuracy of putting and driving.

BACKGROUND OF THE INVENTION

Every golfer wants to improve his or her game and has access to this goal through reams of advice in print, film and on sound video tape. However, when using this media, a golfer has no easy way of knowing whether or not the advice is being followed correctly. Therefore, practice devices have been designed to allow the golfer to monitor various aspects of his or her golf stroke or swings.

Many training devices have been invented that start from the top of the golf swing or stroke. McGwire U.S. Pat. No. 4,693,479 discloses a practice device in which a light shines from the end of the handle onto a wall or floor during practicing of the golf swing. However, this device requires that the golfer take his or her eyes off of the ball in order to follow the light. Golf instructors emphasize that in order to develop accurate golf strokes, it is important that the eyes must be concentrated on the ball.

Taylor U.S. Pat. No. 3,820,795 discloses a light clamped to a golf club head for generating a beam upward and parallel to the shaft. This device permits the golfer to see only the starting path of the swing.

Perkins U.S. Pat. No. 4,456,257 uses three light beams, one on the wrist and two in the club shaft, with a battery pack assembly for power. The use of multiple devices for generating beams at different parts of the body and club results in unnatural redistribution and altering of the weight and feel of the golf club swing using this practice device.

Rabold U.S. Pat. No. 4,911,450 discloses a shortened club with a light beam in the handle and another in the center of the head. The light beam in the head shines 90° from the base of the head causing the eye to follow the beam, rather than the ball.

SUMMARY OF THE INVENTION

According to the present invention, a simple practice device is provided that allows a golfer to improve putting and driving by means of audio and visual feedback. The instant feedback provided by the device of the present invention keeps the user's interest level high, thus making practice a stimulating and exciting experience—a secret in the success of pinball and electronic games.

According to an aspect of the present invention, there is provided a practice device for improving the accuracy of a golf swing, comprising:

(a) a golf club handle and shaft;

(b) a head portion connected to a distal end of said shaft; and (c) means within said head portion for generating a light beam parallel to the axis of said shaft and in a direction away from said handle, whereby upon taking a golf stroke with said device the light beam provides visual indication of the path of said stroke.

BRIEF DESCRIPTION OF THE DRAWINGS

A more detailed description of the preferred embodiment will be provided below in conjunction with the following drawings, in which:

FIG. 1 is a side view (partially in section) of the golf practice device of the present invention for practicing putting and swinging;

FIG. 2 is a bottom view of the device; FIG. 3 is a top view of a backing or base, target line, ball and single electronic receiver for practicing, in accordance the preferred embodiment;

FIG. 4 is a top view of a backing or base, target line, ball and dual electronic receiver for practicing, in accordance with an alternative embodiment of the invention;

FIG. 7 is a perspective view of a golfer at the top of a full golf swing using the alternative embodiment of FIG. 4;

FIG. 8 is a perspective view of the golfer in FIG. 7 at the ball impacting portion of the stroke;

DETAILED DESCRIPTION OF THE PREFERRED EMBODIMENT

Figure 5:
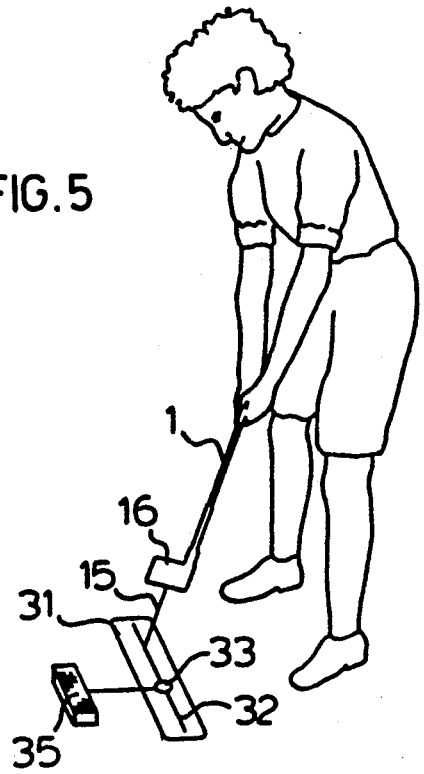
FIG. 5 is a perspective view of a golfer practicing her putting stroke using the preferred embodiment of FIG. 3.

Turning to FIG. 1, the golf practice device according to the broadest aspect of the invention is illustrated comprising a handle 1 connected to shaft 2 around which hosel 3 is fitted and which extends into head portion 16. The head portion includes a planar club face 16A (FIG. 2). The overall length of the device is shorter than a regular club but is weighted to give the same "swing feel" as a regular club.

Within the hosel 3 a combination level-and-centrifugal switch is provided, as well as an on-off switch 5 and a battery charging jack 6.

The head portion 16 contains batteries 7 light bulb 8, lens 9 and an adjustable iris 11. The light beam 15 travels parallel to the center line 14 of the shaft 2.

A plug-in charger 13 of well known design has a lead 12 with attachment 1 for connection to battery charging jack 6, for charging the batteries when the unit is not in use.

Figure 6:
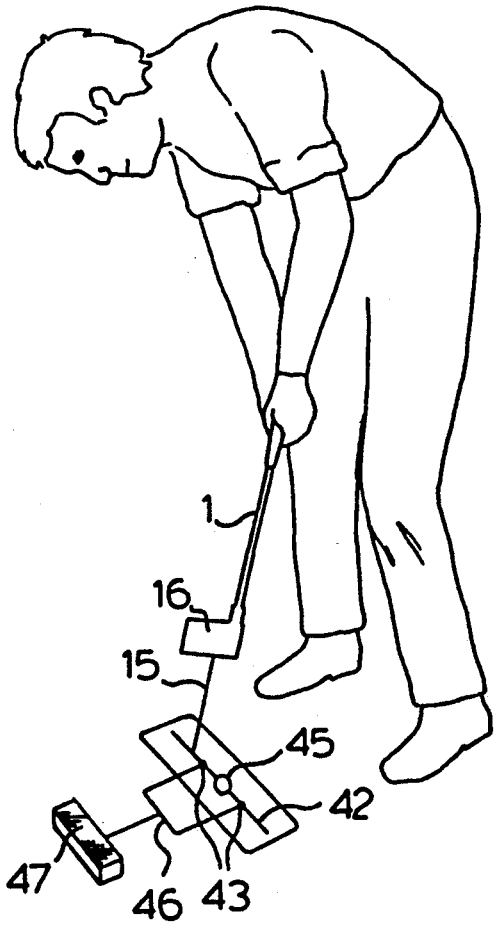
FIG. 6 is a perspective view of a golfer practicing his putting stroke using the alternative embodiment of FIG. 4.

In use, the golfer may practice putting (FIGS. 5 and 6) or a full swing (FIG. 7 and 8). When practicing a full swing the light bulb 8 is enabled by switch 5 when the shaft of the club is level with the ground. Thus, when practicing indoors, the rectangular light beam 15 projects onto a wall 71 (FIG. 7), thereby providing positive feedback when proper form has been achieved at the top of the downswing.

When practicing putting, the combination centrifugal and level switch 4 causes bulb 8 to illuminate, and the path of the light beam 1 provides a visual indication of the arc of the swing as well as whether or not the club is being held square to the desired path of the ball travel.

As shown in FIG. 2, the iris 11 is made adjustable by slides 17, for setting the width of the rectangular beam projected therefrom. The rectangular beam generated by the device of the present invention has a major axis which is perpendicular to the club face 16A (FIGS. 2 and 7) so as to provide the aforementioned visual indication as to whether the club is being held square to the path of ball travel.

According to the preferred embodiment of FIG. 3, a light sensitive electronic receiver is provided for use in conjunction with the practice club of FIGS. 1 and 2. In particular, FIG. 3 depicts a flat base or backing 31, a target line 32 representing the desired path of club travel, and a practice target 33 in the form of a golf ball with an electronic receiver centrally thereof and attached by an electric cord 34 to a control unit 35.

In use, the golfer swings the practice device in the usual manner, switch 4 activates the light bulb 8 causing generation of the rectangular light beam, as discussed above. For a proper swing, the light beam travels along target line 32 and directly over the target 33. The electronic receiver detects the light beam crossing thereover and generates a signal via cord 34 to control unit 35. In response, control unit 35 generates a signal, such as an audible buzz, for providing positive feedback to the golfer that a proper stroke has been achieved. In the event that the stroke is off-center the light beam does not follow the target line 32 and does not illuminate the target 33. As a result, the control unit 35 does not generate any signal.

FIG. 4 shows an alternative embodiment of the invention comprising backing 41on which a target line 42 is placed, golf ball target 45 is positioned on the target line 42, and two electronic receivers 43 are positioned on either side of the golf ball 45 in a straight line along target line 42. Electric cord 46 connects the electronic receivers 43 to control unit 47.

In the embodiment of FIG. 4, the light beam must pass through both receivers 43 in order to activate the signal at control unit 47. This embodiment therefore provides positive feedback only in the event the golf swing passes through the target ball 45 and also in a straight line along target line 42.

Figure 9:
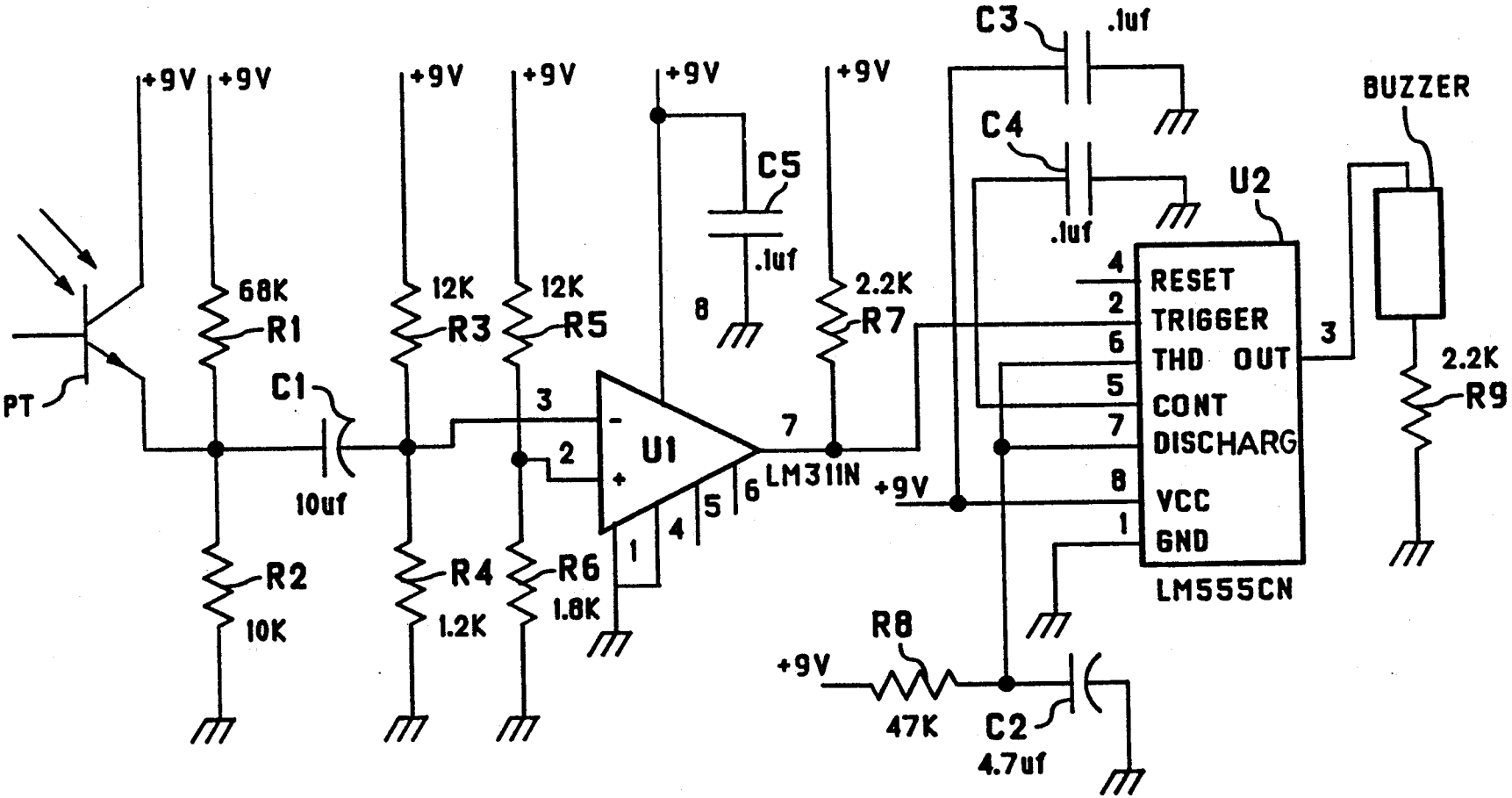
FIG. 9 is a schematic diagram of the single electronic receiver depicted in FIG. 3.

Turning to FIG. 9, circuitry for the receiver of the preferred embodiment is illustrated.

When phototransistor PT is not illuminated, the voltage at the inverting input of differential amplifier U1 is approximately 0.82 volts as a result of the +9 V source being applied to the voltage divider comprising resistors R3 and R4. The voltage on the non-inverting input of comparator U1 remains constant at approximately 1.17 volts, due to the +9 V source applied to voltage divider R5 and R6. Therefore, the comparator U1 normally generates an output of approximately 0.35 volts applied to the trigger input (pin 2) of a monostable multivibrator U2.

However, when the phototransistor PT is illuminated by the light beam 15, transistor PT begins operating in the saturated region, the voltage of the inverting input of amplifier U1 rises toward 9 volts through capacitor C1, causing the output (pin 7) of comparator U1 to become negative. The positive-negative transition on the output of comparator U1 triggers monostable multivibrator U2 to generate an output signal on pin 3 for a predetermined amount of time governed by the RC time constant of resistor R8 and capacitor C2. The output signal from monostable multivibrator U2 (which is configured as a one-shot) is applied to an audible buzzer which in response generates the audible signal.

Figure 10:
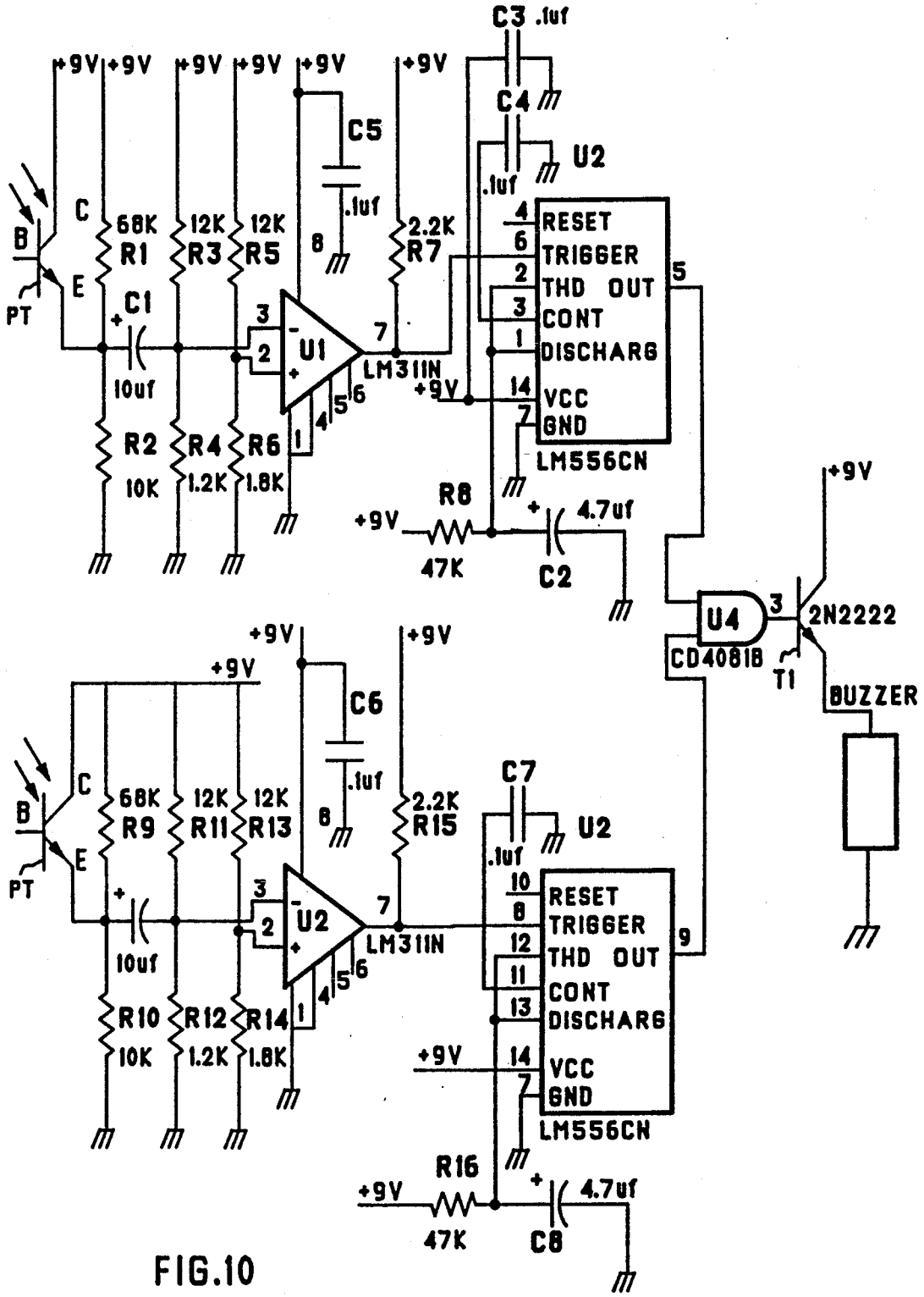
FIG. 10 is a schematic diagram of the dual electronic receiver depicted in FIG. 4.

The schematic diagram of FIG. 10 shows two electronic receivers, each receiver being of identical construction and operationally equivalent to the receiver circuit of FIG. 9. However, the respective outputs (pins 5 and 9) of dual monostable multivibrator U2 are connected to respective inputs of an AND gate U4 whose output (pin 3) is connected to the base terminal of a transistor T1. The AND gate U4 generates a logic high voltage upon receipt of positive output voltages from both outputs of the dual monostable multivibrator U2. The logic high voltage output of AND gate U4 turns on transistor T1 causing the buzzer to sound.

In summary, the practice device of the present invention allows a golfer to practice and improve the putting stroke, which is over thirty-five percent of the game. It can also be used to practice wood and iron shots by changing the stance distance from the ball target to the same distance as is normally used on a golf course. The device of the present invention allows the user to check the position of the backswing to see if he or she is starting at a level position to ground for maximum distance, as taught my most instructors. The device allows the user to practice with a wide rectangular beam, and when repeat accuracy is developed, to narrow the beam for an even more precise stroke. The generated light beam shows the path of the stroke which a normal club would have taken when hitting the golf ball. If the stroke is off-line from the receivers, no sound will be produced. The rectangular beam also shows whether the club is being held square to the desired path of ball travel.

Other embodiments and variations of the invention are possible.

For example, in order to measure the speed of a golf swing, a circuit can be constructed to measure the time difference between the two photo transistors turning on, and based on the measured time difference, the speed may be calculated using a microprocessor.

All such embodiments or variations are believed to be within the sphere and scope of the present invention as define by the claims appended hereto.

The embodiments of the invention in which an exclusive property of privilege is claimed are defined as follows:

1. A practice device for improving the accuracy of a golf swing, comprising:
   (a) a golf club handle and shaft;
   (b) a head portion connected to a distal end of said shaft, said head portion having a planar club face; and
   (c) means within said head portion for generating a rectangular light beam parallel to the axis of said shaft and in a direction away from said handle, a major axis of said rectangular light beam being perpendicular to said planar club face, whereby upon taking a golf stroke with said device the light beam provides visual indication of the path of said stroke.

2. The practice device of claim 1 further comprising means for receiving said light beam and in response generating a signal.

3. The practice device of claim 2 wherein said means for receiving comprises a practice target resembling a golf ball, and a light sensitive receiver centrally thereof for generating a sound responsive to being illuminated by said light beam.

4. The practice device of claim 2 wherein said means for receiving comprises a pair of light sensitive receivers on opposite sides of a golf ball target, and means for generating a sound responsive to both said receivers being successively illuminated by said light beam.

5. The practice device of claim 4, further comprising means for measuring time elapsed between respective ones of said pair of receivers being successively illuminated by said light beam and in response generating a visual display representing speed of said golf stroke.

6. The practice device of claim 2 wherein said means for receiving comprises a photo-transistor connected in a circuit to the trigger input of a one-shot monostable multivibrator, and a buzzer connected to an output of said multivibrator for generating a sound for a predetermined length of time in the event said photo-transistor is illuminated by said light beam so as to trigger said monostable multivibrator.

7. The practice device of claim 2 wherein said means for receiving comprises a pair of photo-transistors connected to respective trigger inputs of a pair of one-shot monostable multivibrators, respective outputs of said multivibrators being connected to inputs of an AND gate, and a buzzer connected to an output of the AND gate for generating a sound in the event both of said photo-transistors are illuminated by said light beam so as to trigger both of said monostable multivibrators and thereby enable said AND gate.

8. The practice device of claim 1 wherein said head portion comprises a light bulb and batteries for generating light, a lens for focusing said light into said light beam, and an adjustable iris for shaping said light beam into a rectangle.

9. The practice device of claim 8 further comprising means for enabling said light beam when said shaft is horizontal, for maintaining said light beam illuminated during said golf swing and disabling said light beam thereafter.

10. The practice device of claim 9, further comprising a hosel surrounding said shaft and extending into said head portion.

11. The practice device of claim 10, wherein said means for enabling said light bulb comprises a combination level and centrifugal switch disposed within said hosel.

12. The practice device of claim 9 further comprising an on-off switch and battery charging jack connected to said batteries.

13. The practice device of claim 1 characterized by a length which is less than the length of standard golf clubs, but weighted so as to emulate the swing characteristics of such standard golf swings.

14. A practice device for improving the accuracy of a golf swing, comprising:

(a) a golf club handle and shaft;

(b) a head portion connected to a distal end of said shaft; and, (c) means within said head portion for generating a light beam parallel to the axis of said shaft and in a direction away from said handle, whereby upon taking a golf stroke with said device the light beam provides visual indication of the path of said stroke, wherein said head portion comprises a light bulb and batteries for generating light, a lens for focusing said light into said light beam, and an adjustable iris for shaping said light beam into a rectangle.

15. The practice device of claim 14 further comprising means for enabling said light beam when said shaft is horizontal, for maintaining said light beam illuminated during said golf swing and disabling said light beam thereafter.

16. The practice device of claim 15 further comprising a hosel surrounding said shaft and extending into said head portion.

17. The practice device of claim 16, wherein said means for enabling said light beam comprises a combination level and centrifugal switch disposed within said hosel.

18. The practice device of claim 15 further comprising an on-off switch and battery charging jack connected to said batteries.

19. An apparatus for improving the accuracy of a golf swing comprising:

an elongated shaft having first and second ends;

a head portion connected to the first end of said shaft;

light generating means within said head portion for generating alight beam parallel to the axis of said shaft and in a direction away from said second end; and, iris means for adjustably shaping said light beam into a rectangle whereby upon taking a golf stroke with said device the light beam provides visual indication of the path of said stroke.

20. The apparatus according to claim 19 further comprising a lens for focusing said generated light beam.

21. The apparatus according to claim 19 further comprising means for receiving said light beam and in response generating a signal.

22. The apparatus according to claim 21 wherein said means for receiving comprises a light sensitive receiver for generating a sound responsive to being illuminated by said light beam.

23. The apparatus according to claim 21 wherein said means for receiving said light beam comprises a pair of light sensitive receivers on opposite sides of a golf ball target, and means for generating a sound responsive to said receivers being illuminated by said light beam.

24. The apparatus according to claim 23, further comprising means for measuring time elapsed between respective ones of said pair of receivers being successively illuminated by said light beam and in response generating a visual display representing speed of said golf stroke.

25. The apparatus according to claim 21 wherein said means for receiving comprises a photo-transistor connected in a circuit to the trigger input of one of a pair of one-shot monostable multivibrators, and a buzzer connected to an output of said multivibrator for generating a sound for a predetermined length of time in the event said photo-transistor is illuminated by said light beam so as to trigger said monostable multivibrator.

26. The apparatus according to claim 21 wherein said means for receiving comprises a pair of light sensitive receivers each comprising a photo-transistor connected in a circuit to the trigger input of one of a pair of one-shot monostable multivibrators, respective outputs of each multivibrator being connected to inputs of an AND gate, and a buzzer connected to an output of the AND gate for generating a sound in the event such photo-transistor is illuminated by said light beam so as to trigger each said monostable multivibrator and thereby enable said AND gate.

27. The apparatus according to claim 19 further comprising means for enabling said light beam when said shaft is horizontal, for maintaining said light beam illuminated during said golf swing and disabling said light beam thereafter.

28. The apparatus according to claim 27 further comprising a hosel surrounding said shaft and extending into said head portion.

29. The apparatus according to claim 28, wherein said means for enabling said light beam comprises a combination level and centrifugal switch disposed within said hosel.

30. The apparatus according to claim 27 further comprising an on-off switch and battery charging jack connected to batteries within said head portion for selectively energizing said light generating means.

31. A golf swing practice apparatus comprising:

a golf club handle on a shaft;

a head portion connected to one end of said shaft;

light generating means within said head portion for generating light;

focusing means on said head portion for focusing said light into a light beam parallel to the axis of said shaft and in a direction away from said handle whereby upon taking a golf stroke with said shaft the light beam provides visual indication of the path of said stroke;

adjustable iris means on said head portion for selectively shaping said light beam into a shaped beam having a substantially rectangular cross section;

light sensitive receiver means for generating a sound responsive to being illuminated by said shaped beam, the light sensitive receiver means comprising i) a pair of light sensitive receivers on opposite sides of a golf ball target on the receiver means, and ii) means for generating a sound responsive to both said receivers being successively illuminated by said shaped beam;

measuring means on said receiver means for measuring time elapsed between respective ones of said pair of receivers being successively illuminated by said shaped beam and in response generating a visual display representing speed of said golf stroke; and, means for enabling said light beam when said shaft is horizontal, for maintaining said light beam illuminated during said golf swing and disabling said light beam thereafter.

* * * * *